United States Patent [19]

Palmer-Ball, Sr.

[11] 4,317,516

[45] Mar. 2, 1982

[54] DEVICE AND METHOD FOR SHIPPING APPLIANCES

[75] Inventor: Marion H. Palmer-Ball, Sr., Louisville, Ky.

[73] Assignee: General Electric Company, Louisville, Ky.

[21] Appl. No.: 126,596

[22] Filed: Mar. 3, 1980

[51] Int. Cl.[3] ..... E05B 65/52

[52] U.S. Cl. ..... 206/320; 206/460; 292/307 A; 292/DIG. 71

[58] Field of Search ..... 206/320, 460, 813; 220/359, DIG. 25; 292/DIG. 71, 307 A; 312/138 R

[56] References Cited

U.S. PATENT DOCUMENTS

| | | | |
|---|---|---|---|
| 2,142,194 | 1/1939 | Karfiol | 206/460 |
| 2,236,938 | 4/1941 | Edelen | 292/288 |
| 2,280,122 | 4/1942 | Hardwick | 292/288 |
| 2,292,024 | 8/1942 | Dreher | 40/140 |
| 2,492,411 | 12/1949 | Barnes et al. | 248/29 |
| 2,574,152 | 11/1951 | Lewis et al. | 206/460 |
| 3,173,826 | 3/1965 | Campbell et al. | 161/161 |
| 3,261,126 | 7/1966 | Marks | 47/41.12 |
| 3,298,271 | 1/1967 | Krueger | 85/32 |
| 3,311,338 | 3/1967 | Culley | 248/205 |
| 3,350,045 | 10/1967 | Mayers | 248/205 |
| 3,785,685 | 1/1974 | MacDonald et al. | 292/288 |
| 3,972,550 | 8/1976 | Boughton et al. | 292/288 |
| 3,972,552 | 8/1976 | Boughton et al. | 206/320 |
| 3,997,204 | 12/1976 | Krempp | 292/288 |
| 3,997,205 | 12/1976 | MacDonald | 292/288 |

*Primary Examiner*—Joseph Man-Fu Moy
*Attorney, Agent, or Firm*—Frederick P. Weidner

[57] ABSTRACT

A method of shipping and a shipping device for an appliance having a cabinet with a hinged door and a sealing gasket therebetween. The shipping device includes a spacer member with a body having two flat surfaces, with each surface having an adhesive coating and one of the adhesive coatings is in contact with the door and the other in contact with the cabinet. The appliance door is maintained in its closed position and retained in its proper vertical position, relative to the cabinet, during shipment.

16 Claims, 5 Drawing Figures

DEVICE AND METHOD FOR SHIPPING APPLIANCES

BACKGROUND OF THE INVENTION

This invention relates to appliances and is more particularly concerned with appliances, such as refrigerators having a cabinet with a hinged door and a sealing gasket therebetween. Specifically, this invention concerns a shipping device and method of shipping such an appliance that keeps the door closed and in its proper position relative to the cabinet.

During shipment of appliances, and particularly household refrigerators, the appliance is sometimes subjected to such severe impacts that the hinged doors are thrown open or the unhinged portion of the door moves vertically with resultant shearing stress to cause damage to the refrigerator cabinet, the door, and/or the hinges. This is particularly a problem in the case of appliances, such as refrigerators, having a relatively heavy door that is to be maintained closed by magnetic means rather than mechanical latch means as the door lacks the structural rigidity afforded by a mechanical latch. Such magnetic means may be incorporated in the door sealing gasket or there may be a magnetic latch that functions in a similar fashion. Appliances that have a door sealing gasket can be subjected to shipping abuse to the extent that the gasket becomes squashed and distorted and often results in its being ineffective as a sealing gasket and needs to be replaced. It is quite desirable to prevent such gasket deformation during shipment.

In order to protect the appliance from damage during shipment, as described above, various packaging systems have been employed, such as taping the door closed and/or placing cardboard supports under the door. Although these heretofore utilized packaging systems have been partially successful in reducing shipping damage, a severe impact can often be sufficient to break the tape, crush the cardboard supports, and free the door, thus making it susceptible to damaging movement during shipment. Moreover, applying and removing a sufficient amount of tape to adequately support the door is time consuming and can cause difficulty during its removal, as it may leave undesirable marks on the appliance that need to be removed.

By my invention, there is provided an appliance shipping device and method of shipping which, when used in conjunction with the appliance, is easy to apply prior to shipment, easy to remove after shipment, and maintains the appliance door in its desired position during shipment, thus eliminating the above-mentioned shipping problems.

SUMMARY OF THE INVENTION

According to one aspect of my invention, there is provided for an appliance having a cabinet with a hinged door and a sealing gasket therebetween a method of shipping and a shipping device. The shipping device includes a spacer member having a body with two flat surfaces, each having an adhesive coating with one of the adhesive coatings being in contact with the door and the other in contact with the cabinet adjacent the sealing gasket. By this arrangement, the appliance door is maintained in its closed position against the cabinet and remains in that position during shipment so that the door will not open and it will not move vertically relative to the cabinet.

DESCRIPTION OF THE PREFERRED EMBODIMENT

Figure 1:
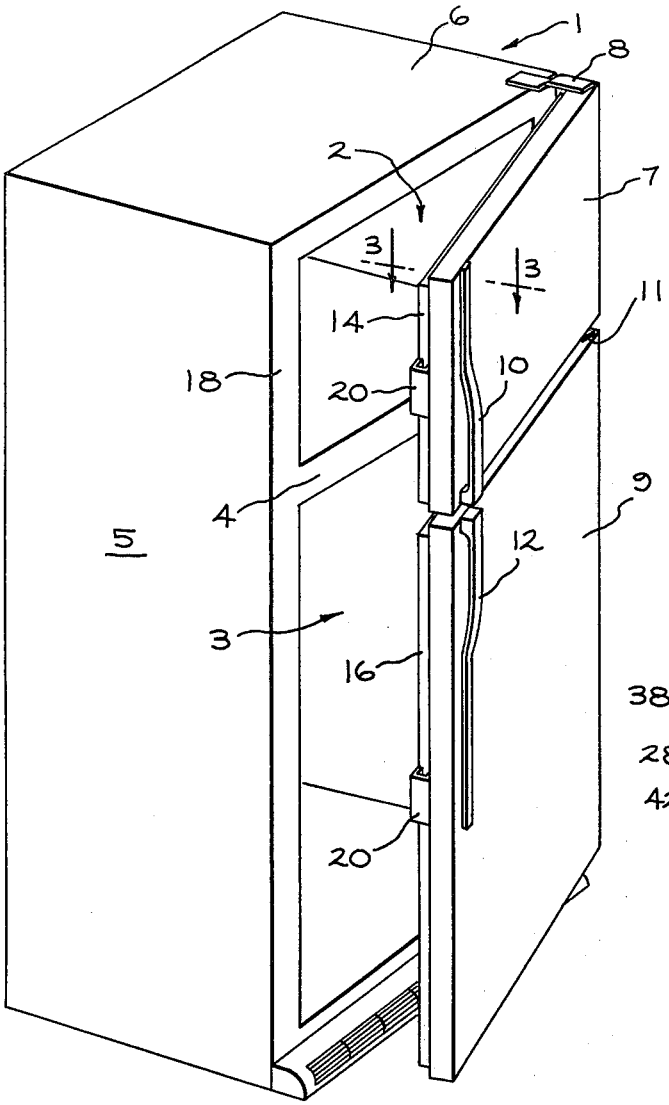
FIG. 1 is a perspective view of a refrigerator cabinet having a freezer compartment on top and a fresh food compartment on the bottom and showing one embodiment of the shipping device of the invention as applied during preparation of the refrigerator for shipment.
Figure 3:
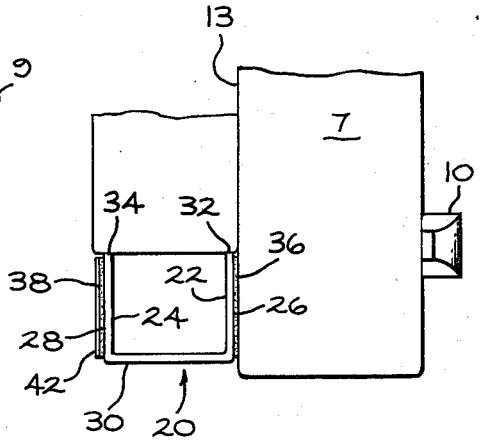
FIG. 3 is a fragmentary view taken along lines 3—3 of FIG. 1.

With particular reference to FIGS. 1 and 3 of the drawings, there is shown one embodiment of the present invention in an appliance such as a household refrigerator 1, having a cabinet 5, including an upper freezer compartment 2 and a lower fresh food compartment 3 separated from the freezer compartment by an insulating partition 4. The respective compartments are also separated from the outer cabinet walls 6 and the spaces between the compartments and these outer cabinet walls 6 are filled by means of thermal insulation. A door 7, having hinges 8 connecting the door 7 and cabinet 5, permits access to the freezer compartment 2 and a door 9, having hinges 11, permits access to the fresh food compartment 3. The doors 7 and 9 may be opened by attached handles 10 and 12 respectively.

In order to help maintain the proper temperature within the freezer compartment 2 and fresh food compartment 3, respectively, there is provided around the freezer door 7, on the inside surface 13 thereof, a sealing gasket 14 and a sealing gasket 16 on the inside surface of the door 9 for the fresh food compartment. The gaskets 14 and 16 are spaced slightly inwardly of the peripheral edges of the respective doors and are made of resilient material, such as elastomeric material. The sealing gaskets 14 and 16 of each door contact the front face 18 of the refrigerator cabinet 5 so that ambient outside air cannot leak into the respective refrigerator compartments 2 and 3 and vice versa. It is common practice to incorporate in the sealing gaskets of refrigerators magnetic material which will maintain the respective refrigerator doors in a closed position when the sealing gaskets engage the front face 18 of the refrigerator cabinet which is made of ferrous metal. Alternatively, of course, the refrigerator doors may have latch means, either magnetic or mechanical; however, it is most common to find the doors of household refrigerators maintained in a closed position by magnetic gaskets.

Figure 2:
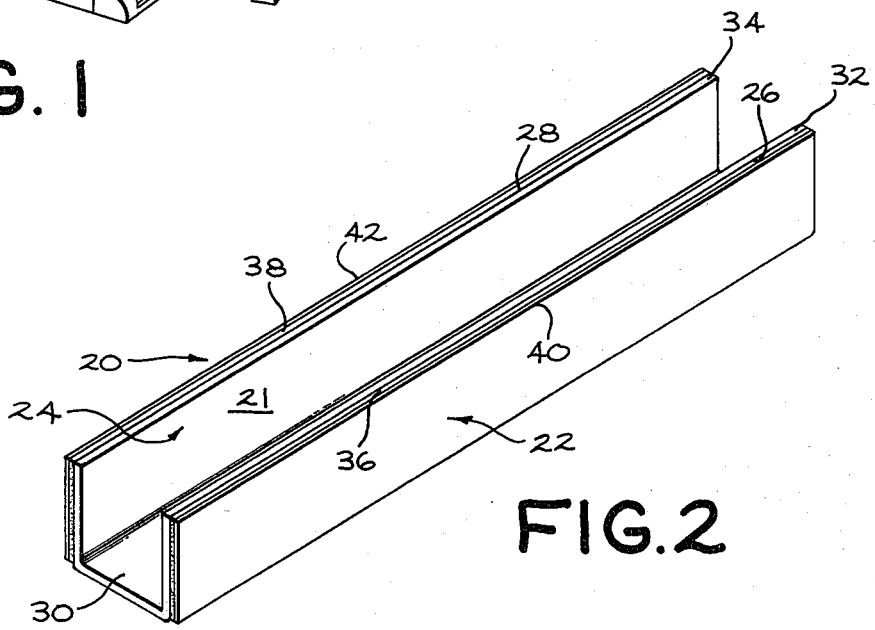
FIG. 2 is a perspective view of one embodiment of the shipping device of the invention.

It is highly desirable to be able to maintain the refrigerator doors in a closed position during shipment so that they do not become ajar when the refrigerator is subjected to impact. Moreover, refrigerator doors are quite heavy and should the refrigerator be subjected to a severe impact upon shipment, the doors could be moved in a vertical direction relative to the cabinet with resultant shearing stress sufficient to cause misalignment of the doors or damage to the hinges. To prevent this, there is provided, as shown particularly in FIG. 2, a spacer member 20 which has a body 21 that may be made of any suitable material, such as polystyrene, and is formed as a U-shaped channel as viewed in lateral cross section (FIGS. 3 and 5) and has two spaced legs 22 and 24, the outer surfaces of which provide flat, elongated surfaces 26 and 28, respectively. The two spaced legs 22 and 24 are joined at one end thereof by a spanning portion 30 and the opposite terminal ends 32 and 34 are free and spaced from each other. Each of the flat, elongated surfaces 26 and 28 has an adhesive coating 36 and 38, respectively. In the preferred embodiment of my invention, the adhesive coating is a tape, both sides of which have adhesive. One side of the tape is adhered to each of the flat surfaces 26 and 28 and the other side is exposed to provide the adhesive coatings 36 and 38. Each of the adhesive coatings 36 and 38, in the preferred embodiment, has an overlying release film 40 and 42, respectively, which is strippable from the adhesive coating when the spacer member 20 is to be used in preparing the refrigerator for shipment.

Figure 4:
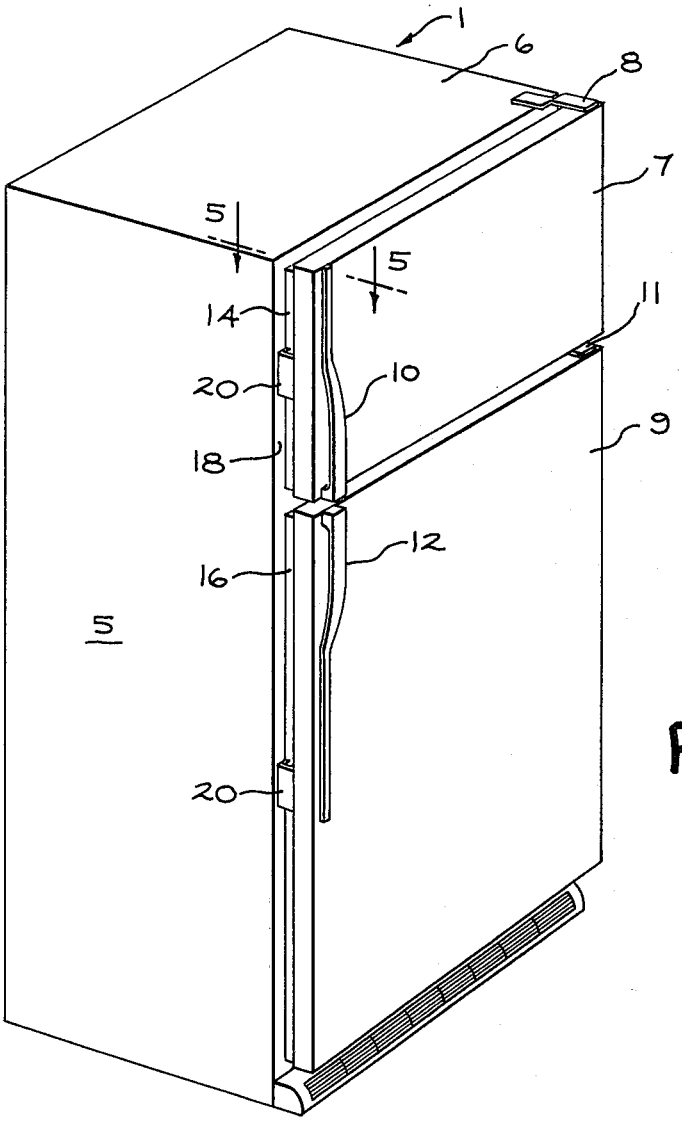
FIG. 4 is a perspective view of the refrigerator showing one embodiment of the shipping device of the invention with the refrigerator in condition for shipment.
Figure 5:
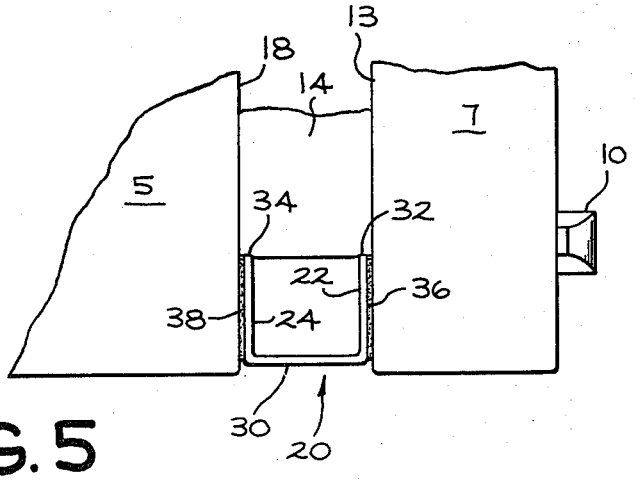
FIG. 5 is a fragmentary view taken along lines 5—5 of FIG. 4.

The method of shipping an appliance, such as refrigerator 1, will now be described. Since preparation of the appliance is the same, whether one, two, or more doors are concerned, only discussion of the method in connection with one door needs to be discussed in detail. The other doors of the appliance, if any, are prepared in the same manner. Using door 7 as an example, it is secured to the cabinet 5 as by hinges 8 along one edge thereof. The spacer member 20 is placed on the door, preferably as shown in FIGS. 1 and 3, by having the free terminal ends 32 and 34 of the legs 22 and 24 of the body 21 in close proximity and preferably abutting the gasket 14. One of the adhesive coatings, such as 36 shown in FIG. 3, is placed in contact with the inside surface 13 of the door 7 and adhered thereto. In the case of the preferred embodiment of the spacer member 20, it will be understood that if the adhesive coating 36 is covered with a release film 40, the release film 40 would be removed before applying the spacer member 20 to the door. It will be further understood that the other adhesive coating 38 will retain its release film 42 when the spacer member 20 is adhered to the door 7. When the refrigerator is ready for shipment and the door is to be finally closed, as just prior to being placed in its shipping carton, if a carton is used in shipment, the release film 42 is removed from the adhesive coating 38 and the door 7 closed so that the adhesive coating 38 comes in contact with the front face 18 of the cabinet 5, whereupon it becomes adhered thereto. This same operation is performed for each door using at least one spacer member 20 for each. While more than one spacer member 20 per door can be used, a single spacer member placed on the door opposite from the hinged side of the door has been found adequate. As shown in FIGS. 4 and 5, the refrigerator is now ready for shipment.

The spacing member body 21 should preferably have a thickness between the two flat surfaces 26 and 28 essentially the same as the thickness of the sealing gasket 14 so that when the door is in its closed position, as shown in FIGS. 4 and 5, it will prevent the gasket 14 from being crushed or distorted inwardly as may be caused by impact of the door 7. Accordingly, the body 21 of the spacer member 20 should be made from material are formed to have sufficient strength to resist the impact forces to which it is expected to be subjected. The spacer member 20 being adhered to both the cabinet 5 and the door 7 will prevent the door from being jarred open during shipment. Moreover, the spacer member 20 will prevent the door from being displaced vertically relative to the cabinet 5 which could, otherwise, cause the door to become misaligned and perhaps even cause damage to the hinges 8. This aspect of my invention is particularly useful in connection with appliances, such as refrigerators, wherein the doors are relatively heavy and are retained in a closed position by magnetic means rather than a mechanical latch means because they are more susceptible to damage from severe impact as the door lacks the structural rigidity afforded by a mechanical latch.

The foregoing is a description of the preferred embodiment of the invention and it should be understood that variations may be made thereto without departing from the true spirit of the invention, as defined in the appended claims.

What is claimed is:

1. In an appliance having a cabinet with a hinged door and a sealing gasket therebetween, a shipping device comprising:

a spacer member positioned adjacent the sealing gasket, said member having a u-shaped body as viewed in lateral cross section and having two spaced legs joined by a spanning portion, said legs providing two flat surfaces, each having an adhesive coating, one said adhesive coating being in contact with the door and the other in contact with the cabinet.

2. The appliance of claim 1 wherein the two spaced legs of the spacer member body have free terminal ends opposite from the spanning portion.

3. The appliance of claim 2 wherein the terminal ends of the spacer member body legs abut the gasket.

4. The appliance of claim 1 wherein the adhesive coating is a two-sided adhesive tape.

5. The appliance of claim 1 wherein the spacer member body has a thickness between the two flat surfaces essentially the same as the thickness of the sealing gasket.

6. The appliance of claim 1 wherein the appliance is a refrigerator with the door adapted to be retained in its closed position by magnetic means.

7. The appliance of claim 1 wherein the spacer member body is formed from polystyrene.

8. The appliance of claim 1 wherein the spacer member is located between the sealing gasket and the outer edge of the door.

9. The method of shipping an appliance having a cabinet with a hinged door and a sealing gasket therebetween comprising:

securing the hinged door with a sealing gasket to the cabinet, forming a spacer member having a u-shaped body as viewed in lateral cross section and having two spaced legs joined by a spanning portion, said legs providing two flat surfaces, each having an adhesive coating, placing one of the adhesive coatings of the spacer member body in contact with the door, and closing the door to place the other adhesive coating of the spacer member body in contact with the cabinet.

10. The method of shipping an appliance, according to claim 9, wherein the adhesive coating is a two-sided adhesive tape applied to each of the flat surfaces of the spacer member body.

11. The method of shipping an appliance, according to claim 9, wherein the spacer member body is formed to have a thickness between the two flat surfaces essentially the same as the thickness of the sealing gasket.

12. The method of shipping an appliance, according to claim 9, wherein the spacer member body is formed whereby the two spaced legs have free terminal ends opposite from the spanning portion.

13. The method of shipping an appliance, according to claim 12, wherein placing one of the adhesive coatings of the spacer member in contact with the door includes abutting the terminal ends of the spacer member legs against the gasket.

14. The method of shipping an appliance having a cabinet with a hinged door and a sealing gasket secured to the door, the hinged door being adapted to be retained in its closed position by magnetic means comprising:

forming a spacer member having a U-shaped body as viewed in lateral cross section which has two spaced legs joined at their one end by a spanning portion and having free terminal ends at the other end, the legs providing first and second elongated, flat surfaces, each having an adhesive coating with a removable release film, said body having a thickness between the two elongated, flat surfaces essentially the same as the thickness of the sealing gasket, removing the release film of a first one of the adhesive coatings of the spacer member and placing the adhesive coating in contact with the door between the sealing gasket and edge of the door in close proximity to the magnetic means, removing the release film of the second one of the adhesive coatings, and closing the door just prior to shipment to contact the second one of the adhesive coatings with the cabinet.

15. The method of shipping an appliance, according to claim 14, wherein the magnetic means is incorporated in the sealing gasket.

16. The method of shipping an appliance, according to claim 14, wherein after closing the door, the appliance is placed in a shipping carton prior to shipment.

* * * * *